US009062261B2

(12) United States Patent
Gao et al.

(10) Patent No.: US 9,062,261 B2
(45) Date of Patent: Jun. 23, 2015

(54) CATALYTIC CRACKING PROCESS FOR REDUCING SULFUR CONTENT IN GASOLINE AND THE DEVICE THEREOF

(75) Inventors: Xionghou Gao, Beijing (CN); Shuhong Sun, Beijing (CN); Lin Wang, Beijing (CN); Xinmei Pang, Beijing (CN); Zhifeng Wang, Beijing (CN); Yongfu Gao, Beijing (CN); Zhaoyong Liu, Beijing (CN); Conghua Liu, Beijing (CN); Jinsen Gao, Beijing (CN); Gang Wang, Beijing (CN); Yanhui Zhang, Beijing (CN); Tao Liu, Beijing (CN); Juanjuan Liu, Beijing (CN)

(73) Assignee: PETROCHINA COMPANY LIMITED (CN)

( * ) Notice: Subject to any disclaimer, the term of this patent is extended or adjusted under 35 U.S.C. 154(b) by 1034 days.

(21) Appl. No.: 12/813,179

(22) Filed: Jun. 10, 2010

(65) Prior Publication Data

US 2010/0314289 A1 Dec. 16, 2010

(30) Foreign Application Priority Data

Jun. 12, 2009 (CN) ..... 2009 1 0086620

(51) Int. Cl.
*C10G 51/02* (2006.01)
*C10G 51/06* (2006.01)
(Continued)

(52) U.S. Cl.
CPC ..... *C10G 51/026* (2013.01); *C10G 51/06* (2013.01); *C10G 11/18* (2013.01); *C10G 11/182* (2013.01);
(Continued)

(58) Field of Classification Search
USPC ..... 208/72–74, 77, 113
See application file for complete search history.

(56) References Cited

U.S. PATENT DOCUMENTS 4,396,531 A * 8/1983 Lomas ..... 502/22
5,376,608 A 12/1994 Wormsbecher et al.
(Continued)

FOREIGN PATENT DOCUMENTS

CN 1206036 A 1/1999
CN 1245202 A 2/2000
(Continued)

OTHER PUBLICATIONS

Machine Translation of CN 1903989, obtained from SIPO database (no date).*
(Continued)

*Primary Examiner* — Renee E Robinson
(74) *Attorney, Agent, or Firm* — Locke Lord LLP; Alan B. Clement; Peter J. Fallon

(57) ABSTRACT

The invention relates to a catalytic cracking process for reducing sulfur content in gasoline and the device thereof, which includes a fluidized bed reactor in addition of a heavy oil catalytic cracking riser, characterized in enhancing contact time of oil-gas with the catalyst, further desulfurizing and reducing olefin content and increasing octane number in gasoline; regenerating all recycling catalysts, quality of products being stable and easily operated, reducing sulfur of gasoline to a maximum limit; adding a cooling device so as to avoid coking when the catalyst contacts with oil-gas in high temperature and decrease of yield of light oil resulted by excessively high reaction temperature of gasoline upgrading, improving products distribution, being flexible to change catalyst-oil ratio and reaction temperature of catalytic cracking reaction. The invention also provides an easily operated process for FCC desulfurization with stronger desulfurizing ability, good selectivity of products and high light oil yield, which can realize 40-80% of FCC gasoline desulfurization. Furthermore, more than 80% of FCC gasoline desulfurization can be achieved if the process is applied in combination with some particular catalysts.

11 Claims, 1 Drawing Sheet

(51) Int. Cl.

| | |
|---|---|
| ***C10G 11/18*** | (2006.01) |
| ***C10G 55/00*** | (2006.01) |
| ***C10G 55/02*** | (2006.01) |

(52) U.S. Cl.

CPC ..... *C10G 11/187* (2013.01); *C10G 2300/70* (2013.01); *C10G 2300/4006* (2013.01); *C10G 2300/107* (2013.01); *C10G 2300/1077* (2013.01); *C10G 2300/104* (2013.01); *C10G 2300/1044* (2013.01); *C10G 55/00* (2013.01); *C10G 55/02* (2013.01)

(56) References Cited

U.S. PATENT DOCUMENTS

| | | | | |
|---|---|---|---|---|
| 6,059,958 | A | 5/2000 | Ramos et al. | |
| 6,287,522 | B1 | 9/2001 | Lomas | |
| 6,495,028 | B1 | 12/2002 | Xu et al. | |
| 2006/0144757 | A1 * | 7/2006 | Steffens et al. | 208/113 |

FOREIGN PATENT DOCUMENTS

| | | | |
|---|---|---|---|
| CN | 1351131 | A | 5/2002 |
| CN | 1401740 | A | 3/2003 |
| CN | 1485414 | A | 3/2004 |
| CN | 1498946 | A | 5/2004 |
| CN | 1176189 | C | 11/2004 |
| CN | 1200083 | C | 5/2005 |
| CN | 1721055 | A | 1/2006 |
| CN | 1861757 | A | 11/2006 |
| CN | 1903989 | A | 1/2007 |
| CN | 101104815 | A | 1/2008 |

OTHER PUBLICATIONS

Machine Translation of CN 101104815, obtained from SIPO database (no date).*

Machine Translation of CN 1721055, obtained from SIPO database (no date).*

* cited by examiner

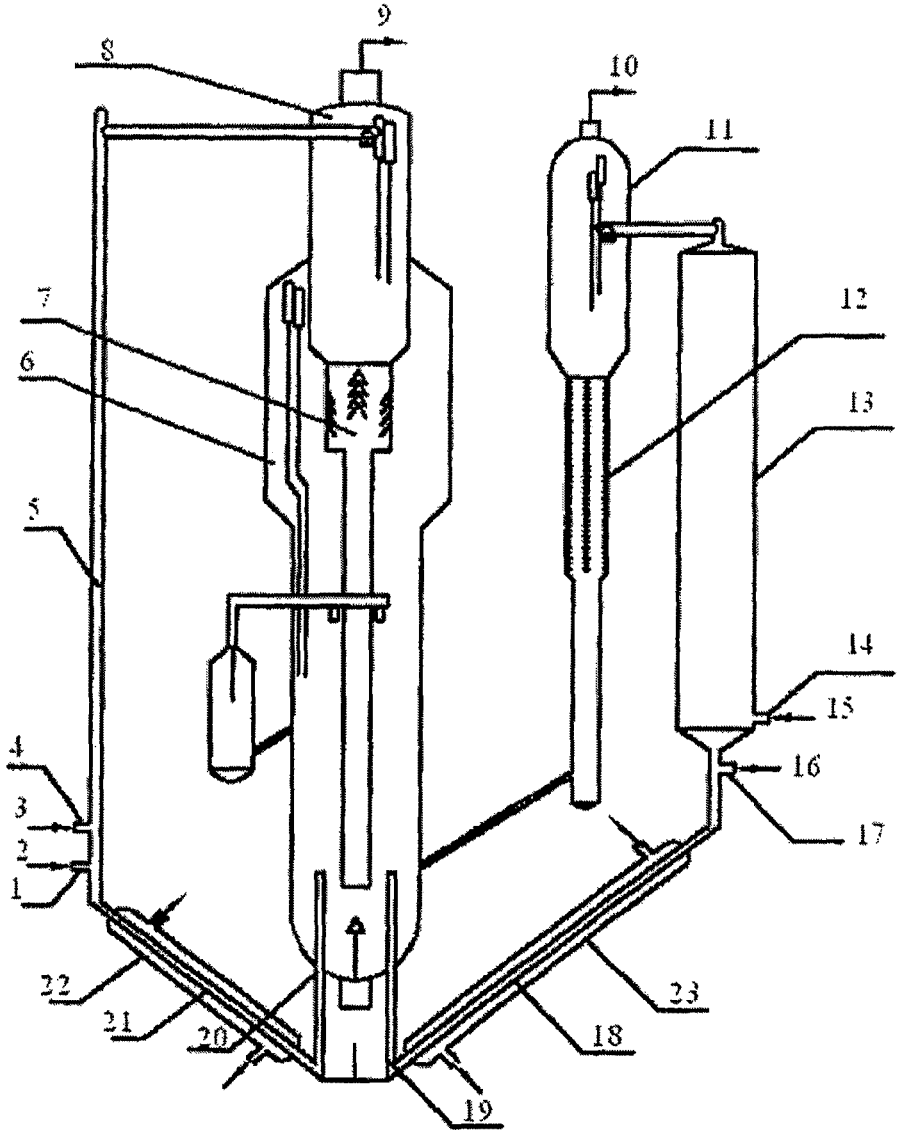
9
8
10
11
7
12
6
13
5
14
15
4
16
3
17
2
1
22
23
21
20
18
19

CATALYTIC CRACKING PROCESS FOR REDUCING SULFUR CONTENT IN GASOLINE AND THE DEVICE THEREOF

TECHNICAL FIELD

The invention relates to a catalytic cracking process for reducing sulfur content in gasoline and the device thereof. Particularly, the present invention relates to a catalytic cracking process for evidently reducing sulfur contents and olefin in gasoline and the device thereof.

BACKGROUND OF THE INVENTION

As rules of environmental protection become more and more strict, Europe enforced Euro II Standard in 1996, Euro III Standard in 2000, and Euro IV Standard in 2005, i.e. sulfur in gasoline must reach up to 10 ppm; in American Tier 2 Standard, sulfur in gasoline is required less than 300 ppm in 2004, and less than 30 ppm in 2005; Asia, Bangkok Thailand, Delhi India and Korea enforced Euro II Standard or standard equal to Euro II Standard successively in 1999 and 2000; Japan enforced more strict standards than Europe with keeping pace with America. Beijing, China enforced Euro II Standard in Jul. 1, 2000, and Euro III Standard in 2005, and aimed to get the vehicle emission standard keep pace with Europe in 2010. Therefore, there is an urgent need to develop a process technology meeting the standard of low-sulfur gasoline.

Since more than 90% of sulfur and more than 90% of olefin in final gasoline are originated from FCC gasoline, it would be paid continuous attention to the quality of FCC gasoline. Currently, the processes of reducing sulfur content in FCC gasoline can be generally divided into three types: removing sulfur in FCC feed oil (pre-hydrotreating process); producing low-sulfur gasoline directly in FCC process; post-treating FCC gasoline.

Pre-hydrotreating of FCC feedstock is an efficient process to reduce sulfur content in gasoline. For example, CN1351131A discloses a process for treating S-containing crude oil comprising combining ordinary-pressure or vacuum distillation, coking or removing asphalt with solvent, medium-pressure hydrocracking and catalyst cracking, so that high-sulfur feed oil with 1.8-2.8% of sulfur can be treated by refinery factory. However, according to the such process, saturation degree of olefin is increased and octane number of gasoline is decreased, and thereby the hydrotreating process requires a great investment and high operation cost.

Currently, various post-treating process of FCC gasoline was developed overseas. For example, ISAL process developed jointly by INTERVEP and UOP, which mainly used to solve the problems of octane number and sulfur content in post-treatment of FCC gasoline. The octane number of gasoline obtained through the ISAL process is higher by 7.4 units than that of ordinary hydrotreating gasoline (road octane number), which meets the requirement of 25 ppm sulfur and of maintaining octane number of gasoline in the refinery factory.

The S-Zorb gasoline desulfurization (SRT) process developed by Phillips Petroleum Company can obtain environmentally friendly gasoline products with minimum lost of octane number and low consumption of hydrogen.

CN1485414A discloses a process for non-hydroaromatizating and desulfurizing catalytically cracking for gasoline, comprising making full-cut of FCC gasoline or light fraction after the fraction being flowed into an aromatizing desulfurizing reactor for aromatization reaction for olefin, performing hydrodesulfurization reaction with the hydrogen produced from aromatization reaction, reducing olefin and sulfur contents in gasoline.

Other post-treating desulfurizing technologies for industrialized gasoline include: SCANfining process jointly developed by Exxon and Akzo; Prime-G$^+$ process of gasoline ultra-deep desulfurization developed by France Petroleum Research Institute, with sulfur content in the obtained gasoline of less than 50 μg/g and desulfurization rate of 97.5%; and ROK-Finer process developed by Japanese Petroleum Company, putting into operation in 2004 with sulfur in the produced gasoline of less than 10 μg/g. Although the post-treating desulfurizing technologies of gasoline has relatively high desulfurization rate, it still needs new devices with increasing device investment.

Directly reducing sulfur content in gasoline during catalytic cracking process mainly commence on catalyst and process. Regarding technology of using sulfur reduction catalyst or the additives, the sulfur reduction additive of GSR series and D-Prism series developed by Grace Davison Company (U.S. Pat. No. 5,376,608) with aluminum oxide/titanium oxide as matrix, supporting L-acid components such as zinc oxide, can be used to reduce sulfur content in FCC gasoline by about 20%-35%; FCC catalyst of SATURN developed by Grace Davison Company can be proved to reduce sulfur content in FCC gasoline by above 50% in industrial test.

With regard to the technology of RESOLVE series additives developed by Akzo Nobel Company, RESOLVE 700 can be used to reduce sulfur content in gasoline of from 600 μg/g to 442 μg/g when processing non-hydrotreating VGO feedstock containing 0.7% of sulfur. The sulfur content in gasoline of full-cut range continues to fall from 442 μg/g to 340 μg/g after adding 10% of RESOLVE 800. Sulfur reduction is carried out by using the sulfur reduction catalyst of NaphthaMaz-LSG developed by Engelhard Company on the basis of NaphthaMax catalyst with high conversion rate and gasoline yield.

Regarding the process technology of reducing sulfur content in gasoline directly during catalytic cracking process, U.S. Pat. No. 6,287,522 B1 refers to LOCC process by using a catalytic cracking device with dual-riser reactor, comprising transporting the mixed spent catalysts consisting of the most non-stripping spent catalyst from a light hydrocarbon riser reactor and a small amount of non-stripping spent catalyst from a heavy oil riser reactor to the bottom of the heavy oil riser reactor through a catalyst delivery pipe, then mixing with a high temperature regenerative catalyst from a regenerator, and then the mixed catalysts go upwards in the heavy oil riser reactor, contacting and reacting with the feeds in the heavy oil riser reactor. The temperature of the catalyst, which is contacted with the feed of heavy oil riser reactor is decreased by using such process, with taking advantage of higher activity and lower temperature of the spent catalyst in the light hydrocarbon riser reactor, reducing thermal cracking reaction of the heavy oil riser reactor, promoting the catalytic cracking reactor, and improving the products distribution. However, the self-recycling catalyst of such process is not conveyed to the light hydrocarbon riser reactor, causing low ratio of catalyst of light hydrocarbon riser reactor to gasoline feed and short reaction time, thus it is too poor to the gasoline desulfurization.

CN1401740A discloses a catalytic converting process for upgrading poor-quality gasoline, including a conventional catalytic cracking step for the heavy oil and a catalytic converting step for upgrading the poor-quality gasoline. It is characterized in that a common catalyst regenerator and a same FCC catalyst are used in both steps. In such process, sulfur content is decreased 15-50 percentage points and octane number of gasoline is increased 0.2-2 units.

CN1176189C discloses a catalytic converting process for upgrading poor-quality gasoline and the device thereof, comprising applying a dual-riser (a heavy oil riser reactor and a gasoline riser reactor) catalytic cracking process and the conventional catalytic cracking catalyst to upgrade the poor-quality gasoline. Desulfurization is realized by conversion of sulfide in gasoline and hydrogen transfer reaction, of which sulfur content in gasoline reduced by 5-30 wt %, resulting the decreased level of sulfur content being limited.

CN1721055 discloses a dual riser catalytic cracking device for decreasing sulfur content in catalytic cracking gasoline, which is used to solve the high sulfur content problem in catalytic cracking gasoline present in the existing conventional catalytic cracking device. The above device comprises a heavy oil riser reactor and a gasoline riser reactor, in which an expanding-structural cylinder layer-shape reactor is put on the vertical stand pipe below the raised air inlet of the gasoline riser reactor; pre-rise medium inlet is put on vertical stand pipe below the layer-shape reactor. By using desulfurization catalytic cracking catalyst, the sulfur content can be decreased by 50-70%, the olefin content can be decreased by 20-40 vol %, and the octane number of gasoline (RON) can be increased by 0.3-2.0 units. The layer-shape reactor of the such device has a reaction temperature of 630-720° C., a reaction pressure of 0.15-0.45 Mpa, a catalyst retention time of 30-200 seconds, and contains a gasoline riser reactor simultaneously. By taking advantage of the layer-shape reactor and the gasoline riser reactor, such process can be used to reduce gasoline content in gasoline greatly. however, the regenerated high temperature catalyst directly flows into the heavy oil riser reactor and the layer-shape reactor without cooling to contact and react with hydrocarbon, causing the catalyst coke immediately and the quality of products is unstable, which is not easily operated and controlled. Otherwise, the layer-shape reactor has high operation temperature with unfavorable to upgrade gasoline and having low yield of gasoline.

CN1861757 relates to a catalytic cracking process for high efficiency decreasing sulfur content in gasoline and the device thereof. In such process, one or more oxidation-reduction treating units are added into the reactor-regenerator system of the existing riser of catalytic cracking device. Under certain reaction conditions and atmosphere, they are contacted with the cycling liquid FCC catalyst to generate oxidation-reduction reaction for adjusting the valence of metal component in the catalyst and meeting the demand of the desulfurizing activity in order to maintain the desulfurizing activity on a high level. Another riser having treatment unit is further added into the reactor-regenerator system to contact the catalytic cracking gasoline with the compound of the catalyst treated by high temperature so as to conduct second cracking reaction, achieving the purposes of desulfurization, decreasing olefin content, and increasing octane number in gasoline. according to such process and the selection of some certain catalysts, the sulfur content in FCC gasoline can be decreased to more than 80% and olefin to 10-25 (v) %, and the research octane number in gasoline cannot be decreased but increased a little.

CN101104815A and CN200610048408.1 relate to the modification of the gasoline riser of existing double riser catalytic cracking device, comprising two kinds of processes: providing a rapid bed reactor on the top of the gasoline riser reactor, or replacing the gasoline riser directly with the rapid bed reactor. Though the modification of gasoline is realized by both the processes, some of regenerated catalysts would flow into the rapid bed reactor to go on reacting. As the reaction goes on, carbon increasingly deposits on the catalyst, resulting in unstable quality of upgraded products of gasoline. The catalyst flowing into the gasoline upgrading reactor does not permit an efficient decreasing temperature treatment, making the temperature of gasoline upgrading reaction uneasily controlled efficiently, also resulting in unstable quality of upgraded products of gasoline.

CN1245202A relates to a novel riser reactor and a hybrid reactor composed of a riser and a fluidized bed, applying two-region reaction to supply favorable conditions for catalytic cracking hydrogen transfer reaction: low temperature and long residence time. Due to pressure balance problem of the catalytic cracking device, highly dense phase bed layer surface cannot be formed either in middle or top portion of the riser. Therefore, an ideal effect cannot be obtained from the hydrogen transfer reaction of the process in industrial implement.

In order to adjust the severity of the reaction in the riser properly when strengthening conversion level of feedstock, CN1206036 discloses a scheme of the cooling regenerated catalyst, i.e. cooling some of the regenerated catalyst. The cooled regenerated catalyst is admixed with non-cooled high temperature regenerated catalyst in pre-lift zone of riser, and flows upward in the presence of pre-lift medium to contact and react with feed oil in reaction zone. The restriction of thermal balance of catalyst is broken down by means that the catalyst cooled, making its convenient to adjust ratio of the catalyst to the oil during the reaction, strengthening the conversion ability of the heavy oil, and improving the products distribution. However, the matter of high olefin content in gasoline is not solved and the effect of sulfur reduction is not realized.

CN1200083C relates to a catalytic cracking combination process including the following steps: cooling 10-80 wt % of the regenerative agent, following by feeding it into the reaction zone of a circulating fluidized bed reactor to contact and react with the gasoline to obtain a reaction oil-gas; then feeding the resulting reaction oil-gas into the subsequent gasoline conversion product separation system and feeding the reacted catalyst into the stripper zone of the circulating fluidized bed reactor to strip; recycling 40-90 wt % of the stripped catalyst into the reaction zone for circulating use and feeding the residual portion into a riser reactor and making it mix with non-cooled regenerative agent and flow upward along the riser reactor in presence of pre-lift medium; injecting the hydrocarbon raw material into riser and making it contact and react with the catalyst, and making reactant flow through the riser outlet and come into a settler; making the oil-gas and the catalyst isolated react, and feeding the oil-gas into the subsequent product separation system, and putting the reacted carbon-deposited catalyst into recycling use after stripping and regeneration. Through the process, the conversion ability of the heavy oil and the quality of the product has been improved. However, as the reaction goes on, carbon deposits increasingly on the catalyst in the circulating fluidized bed reactor, influencing the property of upgraded gasoline product, thus the quality of the product is unstable, and desulfurization cannot be realized to a maximum extent. Regenerated catalyst has high temperature so as to make it easy to coke when contacting with feed oil after flowing into the riser reactor. The operation of the process is unsteady with quality of product unguaranteed.

CN02149314.6 relates to a process of upgrading catalytic gasoline for olefin reduction and the device thereof, comprising feeding the spent catalyst having high activity and low temperature which is through upgrading of catalytic gasoline into a new-added mixing vessel of the catalyst, also introducing the high temperature regenerated catalyst from the original regenerator, and introducing unreacted catalyst which needs to be replaced in the original catalytic cracking device, resulting in that three catalyst flows are admixed under the fluidization of fluidized air from the bottom of the mixing vessel of catalyst, with coke burning reacted. The gasoline upgrading reactor is selected from the group consisting of riser reactor, turbulent bed reactor and rapid bed reactor. The purposes of reducing olefin content and increasing octane number are achieved by such process, but, since coke burning of catalyst is carried out at a temperature of above 600° C., the temperature of the catalyst after coke burning in the mixing vessel cannot be efficiently decreased; it is not sure that the catalysts flowing into the gasoline upgrading reactor are all low temperature catalysts. If high temperature catalyst flows into gasoline upgrading reactor, upgrading of gasoline would be easily overcracking with selectivity of products unstable. The high temperature catalyst flowing into the heavy oil riser reactor would be easily coked. Furthermore, in addition that three catalyst flows are admixed for use, the operation of the process is not easily controlled and the quality of the products is unstable.

The reactors of all the above applications and/or patents are dual riser or hybrid reactor, wherein, some of them not only increase additional reactor units for reduction treatment of the catalytic active components or high temperature (600-700° C.) pre-reaction of the gasoline, but also increase the equipment investment and the process procedures, resulting in the gasoline yield decreasing; the others apply partial regeneration to obtain the regenerated high temperature catalyst, which is not cooled, resulting in bad selectivity of the products and unstable operation.

SUMMARY OF THE INVENTION

The invention aims to provide an easily operated process for FCC desulfurization with stronger desulfurizing ability and high yield of light oil, and the device thereof, which can realize 40-80% of FCC gasoline desulfurization. Furthermore, more than 80% of FCC gasoline desulfurization can be achieved if the process of the present invention is applied in combination with some particular catalysts. The particular catalysts have higher activity for cracking reaction, because the amount of B acid and L acid of such catalysts is so high as to strengthen the function of preferential absorption and cracking of sulfide.

The present invention is realized by modifying existing heavy oil catalytic cracking riser device for increasing fluidized bed reactor which make catalytic cracking gasoline to realize catalytic second cracking reaction, further reducing sulfur content and olefin in catalytic cracking gasoline, and holding the octane number of gasoline not decreasing; regenerating all the reacted catalysts of coke burning, with stable quality of product, good selectivity, easily-controlled operation, thus reducing sulfur in gasoline to a maximum extent; increasing cooling device, avoiding instant coking when high temperature catalysts contact with oil-gas and the yield of light oil decreasing, which is caused by over high reaction temperature of gasoline upgrading, improving the products distribution, creating favorable conditions for flexibly changing the catalyst-oil ratio or the reaction temperature of catalytic cracking reaction.

In one embodiment, the present invention relates to a catalytic cracking device for reducing sulfur content in gasoline, comprising heavy oil riser reactor (5), first settler (8), regenerator (6), second settler (11), wherein the top outlet of the heavy oil riser reactor communicates with the first settler (8), and the bottom of the heavy oil riser reactor connects with the regenerator (6) through first regeneration inclined pipe (21), followed by first regeneration stand pipe (20), characterized in that the device comprises fluidized bed reactor (13), wherein a top outlet of the fluidized bed reactor connects with the second settler (11), and the gasoline feeding inlet is deposited on the fluidized bed reactor, and the lift gas inlet (17) is deposited on the vertical stand pipe below the fluidized bed reactor; the bottom of vertical stand pipe below the lift gas inlet (17) of the fluidized bed reactor is connected with regenerator (6) through second regeneration inclined pipe (18), second regeneration stand pipe (19); riser cooler (22) and fluidized bed cooler (23) are deposited respectively on the middle portion of first regeneration inclined pipe (21) and second regeneration inclined pipe (18). The diameter of the fluidized bed reactor is better to be 3-10 times the diameter of heavy oil riser reactor, and the diameter-height ratio of the fluidized bed reactor is better to be 0.1-0.4. If the diameter-height ratio of the fluidized bed is too big or too small, or the diameter is too big or too small, it would easily cause to form jet flow or channeling in fluidized bed, resulting in decreasing gas-solid contacting efficiency and stability of operation.

It surprisingly found that the beneficial effects of applying the present invention include: during the process, the cooled catalyst of the present invention is lifted by the pre-lift medium (catalytic cracking dry gas, hydrogen, water vapour and carbon monoxide) of the fluidized bed reactor into the fluidized bed reactor to contact and admix with crude gasoline of the heavy oil riser reactor. The diameter of the fluidized bed reactor is relatively large, which is 3-10 times the diameter of the ordinary riser reactor, and the length comparatively short (which is 0.2-0.8 times of the length of ordinary riser). Compared with the ordinary riser reactor, the fluidized bed reactor is characterized in long contact time between the oil and the catalyst with back mixing of the oil-gas and the catalyst. The gasoline and the catalyst fully contacted with each other in low temperature, causing in decomposing sulfide in gasoline greatly, promoting full saturation of olefin in gasoline, which thus more efficiently removes sulfide in gasoline and reduces olefin content, with high yield of light oil.

The present invention applies in form of the heavy oil riser reactor and the fluidized bed reactor. By means of long contact time of the fluidized bed, the sulfur content in gasoline is reduced. If the extent of the catalytic cracking sulfur reduction is insufficient by using the riser, it would be easy to be coked for the catalyst when regenerated high temperature catalyst flows into the heavy oil riser reactor to contact with the oil-gas.

The present invention also provides a catalytic cracking process for reducing sulfur content in gasoline, including following steps in said device:

a) Under the condition of fluid catalytic cracking in heavy oil riser reactor 5, a first reactant flow is obtained by reacting heavy oil feed 3 with the catalyst, and the first reactant flow is isolated in first settler 8 to obtain isolated spent catalyst and isolated oil-gas, the isolated oil-gas flows into a fractionating device to fractionate and the isolated spent catalyst is subjected to stripping and flows into the regenerator 6, the spent catalyst is subjected to coke burning regeneration in the regenerator 6 under the condition of regeneration of fluid catalytic cracking catalyst to obtain a regenerated catalyst;

b) some of the regenerated catalysts flow back into the heavy oil riser reactor 5 through the first regeneration stand pipe 20, the first regeneration inclined pipe 21, and the riser cooler 22, and the others flow into the second regeneration stand pipe 19 and then into the fluidized bed reactor 13 through the second regeneration inclined pipe 18 and the fluidized bed cooler 23;

c) in the fluidized bed reactor 13, a second reactant flow is obtained by contacting the feed of gasoline 15 with the regenerated catalyst from step a) under the condition that the temperature is 300-550° C., the ratio of the regenerated catalyst to the feed of gasoline is 1-15, and the space velocity is 4.0-60.0 $h^{-1}$, the second reactant flow is isolated in the second settler 11 to obtain isolated spent catalyst and isolated oil-gas, the isolated oil-gas flows into the fractionating device to fractionate, and the isolated spent catalyst is subjected to the second stripping 12 and flows into the regenerator 6; the regenerated catalyst is recycled in step b).

The reaction condition of the heavy oil feed in the heavy oil riser reactor is traditional catalytic cracking condition. The common conditions used for the present invention are often as follows: temperature (the temperature of the top outlet of the heavy oil riser) is 300-700° C., reaction time is 0.5-5 seconds, catalyst-oil ratio (weight ratio) is 3-10, and reaction pressure (absolute pressure) is 0.15-0.4 MPa. The reaction conditions of the fluidized bed reactor are that: reaction temperature is generally 300-550° C., preferably 350-500° C.; catalyst-oil ratio of the fluidized bed reactor is generally 1-15, preferably 2-10; reaction space velocity (volume velocity) of the fluidized bed reactor is generally 4.0-60.0 preferably 6.0-30.0$h^{-1}$. The spent catalysts from the heavy oil riser reactor and the fluidized bed reactor are subjected to coke burning regeneration under the condition of regeneration of the catalytic cracking catalyst, and the regeneration temperature is controlled between 650 and 750° C.; the regenerated catalyst is recycled for use after cooling. The common operation condition is provided in the first settler stripping section and the second settler stripping section. In the present invention, in order to avoid over cracking of gasoline and decrease of gasoline yield caused by over high reaction temperature, the regenerated catalyst flows into the fluidized bed reactor after cooling. The reaction temperature of the fluidized bed reactor is relatively lower (preferably 350-500° C.). The recycled catalysts are all regenerated.

The heavy oil feed of the present invention includes atmospheric residual oil, vacuum residual oil, straight-run wax oil, coking wax oil, shale oil, synthetic oil, crude oil, coal tar, recycle oil, oil slurry and deasphalted oil, or the blend of the oils. The fluidized bed reactor can be used to desulfurize the gasoline produced by the heavy oil riser reactor of the catalytic cracking process, but also can be used to dispose the sulfur-contained gasoline produced by the other common devices in the field, especially high-sulfur gasoline. The gasoline feed includes the gasoline having higher sulfur content and the gasoline having different fraction ranges, such as catalytic cracking light gasoline, catalytic cracking heavy gasoline, pyrolysis and thermal cracking light gasoline, pyrolysis and thermal cracking heavy gasoline, coking light gasoline, coking heavy gasoline, cracked ethylene gasoline and so on, and the blend of the oils.

In the present invention, the pre-lift medium of the fluidized bed reactor includes one or more following gas: catalytic cracking dry gas, hydrogen, water vapour and carbon monoxide. The generated gas medium after the reaction, which mainly is gasoline, liquefied gas, dry gas, hydrogen and so on, and the unreacted pre-lift medium of fluidized bed, which mainly is catalytic cracking dry gas, hydrogen, water vapour, carbon monoxide, flow upward with the catalyst. The catalyst is separated with the oil-gas in the second settler, and is stripped with water vapour in the stripping section of the second settler, then flows into the regenerator for coke burning regeneration. During the period of regeneration, an oxidization reaction occurs in sulfide, which is attached to the catalyst, to generate sulfur oxide. The sulfur oxide is discharged to rear device with fume. The regenerated catalyst is recycled for use.

When the common catalytic cracking process, pyrolysis process are modified to the process of the present invention, the above processes can be applied for gasoline desulfurization.

Compared with applying common riser catalytic cracking process, the present invention, in which the riser-fluidized bed reactor catalytic cracking process is used for catalytic cracking desulfurization, can reduce sulfur content of the gasoline by 40-80%, reduce olefin content of the gasoline by 20-40 vol %, and increase RON by 1-5 units when maintaining total liquid yield, and having good distribution in full-device products. The total liquid yield refers to the sum of the liquefied gas, the gasoline and the diesel during the catalytic cracking process.

The present invention is explained in more detail in conjunction with the accompanying drawing and the following Detailed Description of the Invention and embodiments. The accompanying drawing, Detailed Description of the Invention and embodiments are not subjected to limit the claimed scope of the present invention.

BRIEF DESCRIPTION OF THE DRAWINGS

FIG. 1 is a schematic view of a riser-fluidized bed catalytic cracking process of the present invention.

In the FIGURE, 1—lift gas inlet of the heavy oil riser reactor, 2—lift gas of the heavy oil riser reactor, 3—heavy oil feed, 4—heavy oil feed inlet, 5—heavy oil riser reactor, 6—regenerator, 7—stripping section of the first settler, 8—first settler, 9—oil-gas of the heavy oil riser, 10—oil-gas of the fluidized bed, 11—second settler, 12—stripping section of the second settler, 13—fluidized bed reactor, 14—gasoline feed inlet, 15—gasoline feed, 16—pre-lift medium of the fluidized bed reactor, 17—pre-lift medium inlet of the fluidized bed reactor, 18—second regeneration inclined pipe, 19—second regeneration stand pipe, 20—first regeneration stand pipe, 21—first regeneration inclined pipe, 22—riser cooler, 23—fluidized bed cooler.

DETAILED DESCRIPTION OF THE PREFERRED EMBODIMENTS

Referring to FIG. 1, the riser-fluidized bed catalytic cracking process of the present invention comprises heavy oil riser reactor, first settler, regenerator, fluidized bed reactor and second settler. The top outlet of the heavy oil riser reactor is connected with the first settler. The bottom of the heavy oil riser reactor is connected with the regenerator through the first regeneration inclined pipe and the first regeneration stand pipe. A gasoline feed inlet and a pre-lift gas inlet of the fluidized bed reactor are deposited on the fluidized bed reactor. The top outlet of the fluidized bed reactor is connected with the second settler. The bottom of the vertical stand pipe below the pre-lift gas inlet of the fluidized bed reactor is connected with the regenerator through the second regeneration inclined pipe and the second regeneration stand pipe. A riser cooler and a fluidized bed cooler are deposited on the middle portions of the first regeneration inclined pipe and the second regeneration inclined pipe respectively.

The riser-fluidized bed catalytic cracking process of FIG. 1 for reducing sulfur content in catalytic cracking gasoline comprises the steps of:

(a) The heavy oil Feed 3 flows into the heavy oil riser reactor 5 through the heavy oil feed inlet 4. The lift gas 2 of the heavy oil riser reactor, which generally is water vapour, flows into the heavy oil riser reactor 5 through the lift gas inlet 1 of the heavy oil riser reactor. The regenerated catalyst from the regenerator flows into the heavy oil riser reactor 5 through the first regeneration stand pipe 20 and the first regeneration inclined pipe 21, which then is mixed with the heavy oil feed 3 in the bottom of the heavy oil riser reactor 5. Then the heavy oil feed 3 and the regenerated catalyst go upward along the heavy oil riser reactor 5 to contact and react with each other in the heavy oil riser reactor 5 under the condition of conventional catalytic cracking to obtain first reactant flow when finishing. The first reactant flow flows into the first settler 8 through the top outlet of the heavy oil riser reactor 5. In the first settler 8, the first reactant flow is isolated to obtain spent catalyst and oil-gas. The isolated oil-gas 9 obtained from the reaction in the heavy oil riser reactor flows into fraction device for fractionating. The isolated spent catalyst is stripped in the stripping section 7 of the first settler with water vapour and then flows into regenerator 6.

(b) The spent catalyst is regenerated through coke burning in the regenerator 6. Some of the regenerated catalysts are recycled into the heavy oil riser reactor 5 through the first regeneration stand pipe 20, the first regeneration inclined pipe 21 and the riser cooler 22. The others flow into the second regeneration stand pipe 19.

(c) The regenerate catalyst from the regenerator 6 of step (a) flows into the fluidized bed reactor 13 through the second regeneration stand pipe 19, the second regeneration inclined pipe 18 and the fluidized bed reactor 23. The pre-lift medium of the fluidized bed reactor 16 flows from the lift medium inlet 17 of the fluidized bed reactor to admix with the regenerated catalyst of the second regeneration inclined pipe 18 and flow upward to flow into the fluidized bed reactor 13 from the bottom of the fluidized bed reactor 13. In the fluidized bed reactor 13, the gasoline feed 15 flows into the fluidized bed reactor 13 through the gasoline feed inlet 14 to contact and react with the regenerated catalyst, which is lifted by pre-lift gas. Second reactant flow, which is obtained by reacting the regenerated catalyst with feed oil, flows out of the fluidized bed reactor 13 from the top outlet of the fluidized bed reactor 13.

(d) The second reactant flow from the fluidized bed reactor 13 flows into the second settler 11. In the second settler 11, the second reactant flow is isolated to obtain spent catalyst and oil-gas. The isolated oil-gas 10 flows into the fraction device for fractionating. The isolated spent catalyst is stripped in the second settler stripping section 12 with water vapour and then flows into the regenerator 6. The spent catalyst is regenerated through coke burning in the regenerator. Recycled use of the catalyst is realized by repeating the step (b).

EXAMPLE 1

The process is carried out in the riser-fluidized bed reactor catalytic cracking experimental device shown in FIG. 1. The feed oil of the heavy oil riser is 300 million tons/year FCC stocks (with 0.61 wt % of sulfur content), of which the properties listed in table 1. The gasoline feed of the fluidized bed reactor is full-cut gasoline produced by the heavy oil riser reactor (with 679 μg/ml of sulfur content). The diameter-height ratio of the fluidized bed reactor is 0.17, with its diameter being 7.1 times the diameter of the heavy oil riser reactor. The operation conditions and main properties of the gasoline are listed in table 2.

LBO-16 catalyst produced by Catalyst Factory of Lanzhou Petrochemical Corporation of China is used, which is used in the above devices after hydrothermal deactivation treatment with 100% water vapour at 800° C. for 10 hours.

COMPARATIVE EXAMPLE 1

Conventional catalytic cracking process is carried out with the same feed oil as that in example 1. Said process includes heavy oil riser reactor catalytic cracking experimental device without the fluidized bed reactor. LBO-16 industrial catalyst produced by Catalyst Factory of Lanzhou Petrochemical Corporation is used.

The operation conditions and main properties of the gasoline used in example 1 and comparative example 1 are listed in table 2.

EXAMPLE 2

The process is carried out according to example 1, but the reaction temperature of the fluidized bed reactor is 450° C. and the catalyst-oil ratio is 5. The operation conditions and main properties of the gasoline are listed in table 2.

EXAMPLE 3

The process is carried out according to example 1, but the catalyst-oil ratio of the fluidized bed reactor is 5. The operation conditions and main properties of the gasoline are listed in table 2.

EXAMPLE 4

The process is carried out by using the same device in example 1. The feed oil of the heavy oil riser is Xinjiang vacuum wax oil, which is mixed with 30% Xinjiang vacuum residual oil (with 0.38 wt % of sulfur content), and of which the properties listed in table 1. The gasoline feed of the fluidized bed reactor is full-cut gasoline produced by the heavy oil riser reactor (with 450 μg/ml of sulfur content). LHO-1 catalyst produced by Catalyst Factory of Lanzhou Petrochemical Corporation is used.

COMPARATIVE EXAMPLE 2

Conventional catalytic cracking process is carried out with the same feed oil and catalyst as those in example 4. The device includes heavy oil riser reactor.

The operation conditions and main properties of the gasoline used in example 4 and of comparative example 2 are listed in table 3.

EXAMPLE 5

The process is carried out according to example 4, but the reaction temperature of the riser reactor is 470° C., the catalyst-oil ratio of the riser reactor is 5.6, and the reaction temperature of the fluidized bed reactor is 450° C., the catalyst-oil ratio of the fluidized bed reactor is 2, and space velocity is 24.0 $h^{-1}$. The operation conditions and main properties of the gasoline are listed in table 3.

EXAMPLE 6

The process is the same as that in example 1. The feed oil of the heavy oil riser reactor is vacuum wax oil provided by Shandong Shenghua Refinery (with 0.73 wt % of sulfur content), of which the properties listed in table 1. The gasoline feed of fluidized bed reactor is 0-75° C. gasoline produced by the heavy oil riser reactor. LBO-12 industrial catalyst produced by Catalyst Factory of Lanzhou Petrochemical Corporation is used.

COMPARATIVE EXAMPLE 3

Conventional catalytic cracking process is used with the same feed oil and catalyst as those in example 6. The device includes heavy oil riser reactor.

The operation conditions and main properties of the gasoline used in example 6 and Comparative example 3 are listed in table 4 (the properties of the gasoline which is reacted through the fluidized bed reactor with different fractions of gasoline as the feed are represented in the table).

EXAMPLE 7

The process is carried out according to example 6, but the gasoline feed of the fluidized bed reactor is 75-120° C. gasoline. The operation conditions and main properties of the gasoline are listed in table 4.

EXAMPLE 8

The process is carried out according to example 6, but the gasoline feed of the fluidized bed reactor is 120-205° C. gasoline. The operation conditions and main properties of the gasoline are listed in table 4.

EXAMPLE 9

The process is the same as that in example 1. The feed oil of the heavy oil riser reactor is 300 million tons/year FCC stocks (with 0.61 wt % of sulfur content), of which the properties listed in table 1. The gasoline feed of the fluidized bed reactor is 75-205° C. gasoline produced by the heavy oil riser reactor. A complex formulation of 75% LBO-16 industrial catalyst and 25% LB-2 industrial catalyst is used.

COMPARATIVE EXAMPLE 4

Conventional catalytic cracking process is used with the same mixed feed oil as that in example 9. The device includes heavy oil riser reactor. The generated gasoline is fractioned 75-205° C. gasoline (with 1003 μg/ml of sulfur content). LBO-16 industrial catalyst produced by Catalyst Factory of Lanzhou Petrochemical Corporation is used.

EXAMPLE 10

The process is carried out according to example 9, but the catalyst-oil ratio of the heavy oil riser reactor is 7.4 and the catalyst-oil ratio of the fluidized bed reactor is 10. The operation conditions and main properties of the gasoline are listed in table 5.

EXAMPLE 11

The process is carried out according to example 9, but the reaction time of the heavy oil riser reactor is 3.47 seconds, the catalyst-oil ratio of the fluidized bed reactor is 2, the diameter-height ratio of the fluidized bed reactor is 0.33, which is 8.8 times the diameter of the heavy oil riser reactor. The operation conditions and main properties of the gasoline are listed in table 5.

EXAMPLE 12

The process is carried out according to example 9, but the reaction temperature of the heavy oil riser reactor is 470° C., and the reaction time of the heavy oil riser reactor is 3.67 seconds. The operation conditions and main properties of the gasoline are listed in table 5.

EXAMPLE 13

The process is carried out according to example 9, but the reaction temperature of the heavy oil riser reactor is 470° C., the catalyst-oil ratio of the heavy oil riser reactor is 6.0, and the reaction time is 2.8 seconds, and the catalyst-oil ratio of the fluidized bed reactor is 10. The operation conditions and main properties of the gasoline are listed in table 5.

EXAMPLE 14

The process is the same as that in example 1. The feed oil of the heavy oil riser reactor is vacuum wax oil provided by Shandong Shenghua Refinery (with 0.73 wt % of sulfur content). The gasoline feed of the fluidized bed reactor is full-cut gasoline produced by heavy oil riser reactor. A complex formulation of 75% LBO-12 industrial catalyst and 25% LB-2 industrial catalyst is used. The operation conditions and main properties of the gasoline are listed in table 6.

COMPARATIVE EXAMPLE 5

Conventional catalytic cracking process is used. LRC-99 industrial catalyst produced by Catalyst Factory of Lanzhou Petrochemical Corporation is used. The feed oil is the same as that in example 14. The operation conditions and main properties of the gasoline are listed in table 6.

EXAMPLE 15

The process is the same as that in example 1, in which the feed oil of the heavy oil riser reactor is the same as that in example 9. The gasoline feed of the fluidized bed reactor is full-cut gasoline produced by the heavy oil riser reactor. LB-2 industrial catalyst produced by Catalyst Factory of Lanzhou Petrochemical Corporation is used. The operation conditions of the heavy oil riser reactor and the fluidized bed reactor are the same as those in example 3. Products distribution in the two reactors and main properties of the gasoline are listed in table 7.

COMPARATIVE EXAMPLE 6

The process is the same as that in example 15, but there is no cooler in the middle portion of the first regeneration inclined pipe. Products distribution in the two reactors and main properties of the gasoline are listed in table 7.

COMPARATIVE EXAMPLE 7

The process is the same as that in example 1, but there is no cooler in the middle portion of the second regeneration inclined pipe. Products distribution in the two reactors and main properties of the gasoline are listed in table 7.

COMPARATIVE EXAMPLE 8

The process is the same as that in example 1, but there is no cooler in the middle portions of both the first and second regeneration inclined pipes. Products distribution in the two reactors and main properties of the gasoline are listed in table 7.

TABLE 1

The Properties of the Feed Oil

| Items | | Vacuum wax oil of Shenghua | Complex formulation of Xinjiang vacuum wax oil and 20% Xinjiang vacuum residual oil | Complex formulation of Xinjiang vacuum wax oil and 30% Xinjiang vacuum residual oil | 300 million tons/year FCC stocks of Lanzhou Petrochemica Corporation |
|---|---|---|---|---|---|
| $\rho_{20}$, g/cm$^3$ | | 0.892 | 0.892 | 0.885 | 0.878 |
| Viscosity mm$^2$/s | | | | | |
| 100° C. | | — | 10.86 | 9.52 | 17.08 |
| 80° C. | | — | — | 15.80 | — |
| Flash point° C. | | 212 | 218 | — | 224 |
| Freezing point° C. | | 38 | 32 | — | — |
| Carbon residue | | — | — | 2.70 | 5.04 |
| Heavy metals | Cu | 0.18 | 0.27 | 0.14 | 0.46 |
| | Pb | 0.04 | 0.02 | 0.04 | 0.03 |
| Analysis of | Fe | 23.86 | 9.80 | 11.60 | 60.50 |
| | Ni | 0.60 | 5.40 | 7.08 | 9.14 |
| | V | 0.04 | 0.52 | 2.04 | 22.12 |
| Element Analysis mg/g | S | 0.73 | 0.32 | 0.38 | 0.61 |
| Group composition | Saturated hydrocarbon | 59.2 | 64.9 | 56.5 | 61.6 |
| | Aromatic | 39.2 | 29.3 | 25.9 | 24.9 |
| | Colloid | 1.6 | 3.0 | 9.9 | 13.5 |
| Molecular weight M | | 377 | 415 | — | 432 |

Table 2

Operation Conditions of Admixing Heavy Oil and Main Properties of Gasoline

| Items | Comparative example 1 | Example 1 | Example 2 | Example 3 |
|---|---|---|---|---|
| Reaction temperature of the heavy oil riser reactor/° C. | 500 | 500 | 500 | 500 |
| Catalyst-oil ratio of the heavy oil riser reactor | 5.6 | 5.6 | 5.6 | 5.6 |
| Reaction time/s | 2.02 | 2.02 | 2.02 | 2.02 |
| Regeneration temperature of the catalyst/° C. | 690 | 690 | 690 | 690 |
| Reaction temperature of the fluidized bed reactor/° C. | — | 400 | 450 | 400 |
| Catalyst-oil ratio of the fluidized bed reactor | — | 10 | 5 | 5 |
| Products distribution/m % | | | | |
| Dry gas | 1.27 | 1.79 | 1.57 | 1.53 |
| Liquefied gas | 15.73 | 21.01 | 21.77 | 18.89 |
| $C_5^+$gasoline | 48.33 | 38.56 | 38.43 | 40.42 |
| Diesel | 15.19 | 17.16 | 17.37 | 18.38 |
| Heavy oil | 10.83 | 10.83 | 10.83 | 10.83 |
| Coke | 8.36 | 9.96 | 9.42 | 9.36 |
| Light oil yield/m % | 63.52 | 55.72 | 55.80 | 58.80 |
| Total liquid yield/m % | 79.25 | 76.73 | 77.57 | 77.69 |
| Main properties of gasoline | | | | |
| Sulfur content/μg/ml | 679 | 218 | 260 | 355 |
| Octane number(RON) | 88.3 | 94.6 | 92.1 | 92.1 |
| Olefin Content/v % | 47.55 | 5.46 | 14.29 | 17.63 |
| Sulfur content reduction/%[1] | — | 67.84 | 61.65 | 47.73 |
| Octane number (RON) increase[2] | — | 6.3 | 3.8 | 3.8 |

Table 2-continued

Operation Conditions of Admixing Heavy Oil and Main Properties of Gasoline

| Items | Comparative example 1 | Example 1 | Example 2 | Example 3 |
|---|---|---|---|---|
| Olefin content reduction/m %[3] | — | 42.09 | 33.26 | 29.92 |

NOTE:

Table 2 [1]Comparing to Comparative example 1, reduction percentage.

Table 2 [2]Comparing to Comparative example 1, absolute increment value.

Table 2 [3]Comparing to Comparative example 1, absolute reduction value.

TABLE 3

Operation Conditions of Admixing Heavy Oil and Main Properties of Gasoline

| Items | Comparative example 2 | Example 4 | Example 5 |
|---|---|---|---|
| Reaction temperature of the heavy oil riser reactor/° C. | 500 | 500 | 470 |
| Catalyst-oil ratio of the heavy oil riser reactor | 5.6 | 7.4 | 5.6 |
| Regeneration temperature of the catalyst/° C. | 690 | 690 | 690 |
| Reaction temperature of the fluidized bed reactor/° C. | — | 400 | 450 |
| Catalyst-oil ratio of the fluidized bed reactor | — | 5 | 2 |
| Space velocity of the fluidized bed reactor/h$^{-1}$ | — | 1.2 | 24.0 |
| Products distribution/m % | | | |
| Dry gas | 1.10 | 1.36 | 1.29 |
| Liquefied gas | 13.61 | 16.83 | 15.42 |
| $C_5^+$gasoline | 57.63 | 50.05 | 51.80 |
| Diesel | 14.98 | 18.17 | 18.17 |

TABLE 3-continued

| Operation Conditions of Admixing Heavy Oil and Main Properties of Gasoline | | | |
|---|---|---|---|
| Items | Comparative example 2 | Example 4 | Example 5 |
| Heavy oil | 7.80 | 7.80 | 7.80 |
| Coke | 4.56 | 5.04 | 4.99 |
| Light oil yield/m % | 72.61 | 68.22 | 69.97 |
| Total liquid yield/m % | 86.22 | 85.05 | 85.39 |
| Main properties of gasoline | | | |
| Sulfur content/μg/ml | 450 | 132 | 268 |
| Octane number(RON) | 91.0 | 93.9 | 91.8 |
| Olefin Content/v % | 39.8 | 10.07 | 24.45 |

TABLE 3-continued

| Operation Conditions of Admixing Heavy Oil and Main Properties of Gasoline | | | |
|---|---|---|---|
| Items | Comparative example 2 | Example 4 | Example 5 |
| Sulfur content reduction/%[1] | — | 70.67 | 40.44 |
| Octane number (RON) increase[2] | — | 2.9 | 0.8 |
| Olefin content reduction/m %[3] | — | 29.73 | 15.35 |

NOTE:
Table 3 [1]Comparing to Comparative example 2, reduction percentage.
Table 3 [2]Comparing to Comparative example 2, absolute increment value.
Table 3 [3]Comparing to Comparative example 2, absolute reduction value.

TABLE 4

| Fraction Range and Main Properties of Gasoline | | | | | | |
|---|---|---|---|---|---|---|
| Items | Comparative example 3 | | | Example 6 | Example 7 | Example 8 |
| Reaction temperature of the heavy oil riser reactor/° C. | 500 | | | 500 | 500 | 500 |
| Catalyst-oil ratio of the heavy oil riser reactor | 5.6 | | | 5.6 | 5.6 | 5.6 |
| Regeneration temperature of the catalyst/° C. | 690 | | | 690 | 690 | 690 |
| Fraction range of the gasoline/° C. | 0-75 | 75-120 | 120-205 | 0-75 | 75-120 | 120-205 |
| Reaction temperature of the fluidized bed reactor/° C. | — | | | 400 | 400 | 400 |
| Catalyst-oil ratio of the fluidized bed reactor | — | | | 5 | 5 | 5 |
| Main properties of gasoline | | | | | | |
| Sulfur content/μg/ml | 93 | 423 | 1345 | 90 | 181 | 380 |
| Octane number (RON) | 90.8 | 85.4 | 92 | 95.8 | 90.2 | 95.3 |
| Olefin Content/v % | 49.95 | 38.9 | 15.0 | 19.28 | 6.99 | 9.32 |
| Sulfur content reduction/%[1] | — | | | 3.20 | 57.20 | 71.70 |
| Octane number (RON) increase[2] | — | | | 5.0 | 4.8 | 3.0 |
| Olefin content reduction/m %[3] | — | | | 30.67 | 31.92 | 5.50 |

NOTE:
Table 4 [1]Comparing to Comparative example 3, reduction percentage.
Table 4 [2]Comparing to Comparative example 3, absolute increment value.
Table 4 [3]Comparing to Comparative example 3, absolute reduction value.

TABLE 5

| Operation Conditions of Admixing Heavy Oil and Main Properties of Gasoline | | | | | | |
|---|---|---|---|---|---|---|
| Items | Comparative example 4 | Example 9 | Example 10 | Example 11 | Example 12 | Example 13 |
| Reaction temperature of the heavy oil riser reactor/° C. | 500 | 500 | 500 | 500 | 470 | 470 |
| Catalyst-oil ratio of the heavy oil riser reactor | 5.6 | 5.6 | 7.4 | 5.6 | 5.6 | 6.0 |

TABLE 5-continued

| Operation Conditions of Admixing Heavy Oil and Main Properties of Gasoline | | | | | | |
|---|---|---|---|---|---|---|
| Items | Comparative example 4 | Example 9 | Example 10 | Example 11 | Example 12 | Example 13 |
| Reaction time/s | 2.02 | 2.00 | 1.99 | 3.47 | 3.67 | 2.80 |
| Regeneration temperature of the catalyst/° C. | 690 | 690 | 690 | 690 | 690 | 690 |
| Reaction temperature of the fluidized bed reactor/° C. | — | 400 | 400 | 400 | 400 | 400 |
| Catalyst-oil ratio of the fluidized bed reactor | — | 5 | 10 | 2 | 5 | 10 |
| Products distribution/m % | | | | | | |
| Dry gas | 1.27 | 1.62 | 1.83 | 2.93 | 1.90 | 1.71 |
| Liquefied gas | 15.73 | 19.59 | 22.45 | 28.84 | 21.38 | 22.00 |
| $C_5^+$gasoline | 48.33 | 41.51 | 41.46 | 37.49 | 43.31 | 38.53 |
| Diesel | 15.19 | 17.63 | 15.96 | 11.82 | 16.29 | 17.44 |
| Heavy oil | 10.83 | 8.64 | 6.23 | 3.43 | 3.43 | 8.76 |
| Coke | 8.36 | 10.39 | 11.42 | 14.95 | 13.11 | 10.91 |
| Light oil yield/m % | 63.52 | 59.14 | 57.42 | 49.31 | 59.60 | 55.97 |
| Total liquid yield/m % | 79.25 | 78.73 | 79.87 | 78.15 | 80.98 | 77.97 |
| Main properties of gasoline | | | | | | |
| Sulfur content/μg/ml | 1003 | 491 | 323 | 382 | 405 | 267 |
| Octane number(RON) | 89.2 | 90.0 | 91.3 | 94.2 | 94.3 | 90.5 |
| Olefin Content/v % | 29.13 | 7.64 | 5.35 | 3.04 | 4.52 | 5.87 |
| Sulfur content reduction/%[1] | — | 51.01 | 67.83 | 61.89 | 59.59 | 73.34 |
| Octane number (RON) increase[2] | — | 0.8 | 2.1 | 5.0 | 5.1 | 1.3 |
| Olefin content reduction/m %[3] | — | 21.49 | 23.78 | 26.09 | 24.61 | 23.26 |

NOTE:
Table 5 [1]Comparing to Comparative example 4, reduction percentage.
Table 5 [2]Comparing to Comparative example 4, absolute increment value.
Table 5 [3]Comparing to Comparative example 4, absolute reduction value.

TABLE 6

| Main Properties of Vacuum Wax Oil and Gasoline | | |
|---|---|---|
| Items | Comparative example 5 | Example 14 |
| Reaction temperature of the heavy oil riser reactor/° C. | 500 | 500 |
| Catalyst-oil ratio of the heavy oil riser reactor | 5.6 | 6.0 |
| Regeneration temperature of the catalyst/° C. | 690 | 690 |
| Reaction temperature of the fluidized bed reactor/° C. | — | 450 |
| Catalyst-oil ratio of the fluidized bed reactor | — | 10 |
| Products distribution/m % | | |
| Dry gas | 1.03 | 1.31 |
| Liquefied gas | 13.01 | 16.35 |
| $C_5^+$gasoline | 48.03 | 40.06 |
| Diesel | 20.80 | 24.12 |
| Heavy oil | 12.70 | 12.70 |
| Coke | 4.13 | 4.79 |
| Light oil yield/m % | 68.83 | 64.18 |
| Total liquid yield/m % | 81.84 | 80.53 |

TABLE 6-continued

| Main Properties of Vacuum Wax Oil and Gasoline | | |
|---|---|---|
| Items | Comparative example 5 | Example 14 |
| Main properties of gasoline | | |
| Sulfur content/μg/ml | 857 | 170 |
| Octane number(RON) | 90.8 | 95.2 |
| Olefin Content/v % | 47.20 | 11.54 |
| Sulfur content reduction/%[1] | — | 80.16 |
| Octane number (RON) increase[2] | — | 4.4 |
| Olefin content reduction/m %[3] | — | 35.66 |

NOTE:
Table 6 [1]Comparing to Comparative example 5, reduction percentage.
Table 6 [2]Comparing to Comparative example 5, absolute increment value.
Table 6 [3]Comparing to Comparative example 5, absolute reduction value.

TABLE 7

| Products Distribution of Two Reactions and Main Properties of Gasoline | | | | |
|---|---|---|---|---|
| Items | Comparative example 6 | Comparative Example 7 | Comparative Example 8 | Example 15 |
| Products distribution/m % | | | | |
| Dry gas | 1.10 | 1.36 | 1.27 | 1.23 |
| Liquefied gas | 14.63 | 16.37 | 15.70 | 15.67 |
| $C_5^+$gasoline | 40.92 | 40.52 | 39.34 | 41.85 |
| Diesel | 22.60 | 21.22 | 22.60 | 21.22 |
| Heavy oil | 9.93 | 8.83 | 9.93 | 8.83 |
| Coke | 10.12 | 11.00 | 10.47 | 10.53 |
| Light oil yield/m % | 63.52 | 61.74 | 61.94 | 63.07 |
| Total liquid yield/m % | 78.15 | 78.11 | 77.64 | 78.74 |
| Main properties of gasoline | | | | |
| Sulfur content/μg/ml | 376 | 372 | 392 | 313 |
| Octane number(RON) | 91.3 | 91.6 | 91.1 | 92.1 |
| Olefin Content/v % | 17.32 | 15.91 | 25.64 | 10.55 |

The invention claimed is:

1. A catalytic cracking process for reducing sulfur content in gasoline, said process comprising:

feeding a heavy oil feed to a catalytic cracking device containing a heavy oil riser reactor, a first settler, a regenerator, a second settler, wherein the top outlet of the heavy oil riser reactor communicates with the first settler, and the bottom of the heavy oil riser reactor connects with the regenerator through a first regeneration inclined pipe, followed by a first regeneration stand pipe, said device comprises a fluidized bed reactor, wherein a top outlet of the fluidized bed reactor connects with the second settler, and a gasoline feeding inlet is deposited on the fluidized bed reactor, and a lift gas inlet is deposited on a vertical stand pipe below the fluidized bed reactor; the bottom of vertical stand pipe below the lift gas inlet of the fluidized bed reactor is connected with the regenerator through a second regeneration inclined pipe, a second regeneration stand pipe; the regenerated catalyst from regenerator flows into the heavy oil riser reactor and the fluidized bed reactor after cooling through a riser cooler and a fluidized bed cooler, said process further comprising the steps of;

a) a step consisting essentially of obtaining under the condition of fluid catalytic cracking in the heavy oil riser reactor, a first reactant flow by reacting the heavy oil feed with a catalyst, and the first reactant flow is isolated in the first settler to obtain isolated spent catalyst and isolated oil-gas, the isolated oil-gas flows into a fractionating device to fractionate and the isolated spent catalyst is subjected to stripping in a stripping section of the first settler and flows into the regenerator, the spent catalyst is subjected to coke burning regeneration in the regenerator under the condition of regeneration of fluid catalytic cracking catalyst to obtain a regenerated catalyst;

b) a step consisting essentially of providing a portion of the regenerated catalyst which flows back into the heavy oil riser reactor through the first regeneration stand pipe, the first regeneration inclined pipe, and the riser cooler, and another portion of the regenerated catalyst flows into the second regeneration stand pipe and then into the fluidized bed reactor by using a pre-lift medium through the second regeneration inclined pipe and the fluidized bed cooler; and c) a step consisting essentially of obtaining a second reactant flow by contacting a gasoline feed in the fluidized bed reactor with the regenerated catalyst from step a) under the condition that the temperature is 300-550° C., the ratio of the regenerated catalyst to the feed of gasoline is 1-15, and the space velocity is 4.0-60.0$h^{-1}$, the second reactant flow is isolated in the second settler to obtain isolated spent catalyst and isolated oil-gas, the isolated oil-gas flows into the fractionating device to fractionate, and the isolated spent catalyst is subjected to a second stripping in a stripping section of the second settler and flows into the regenerator; the regenerated catalyst is recycled in step b).

2. The catalytic cracking process for reducing sulfur content in gasoline of claim 1, wherein the heavy oil riser reactor in step (a) is carried out under the reaction conditions of temperature of top outlet of heavy oil riser of 300-700° C., reaction time of 0.5-5seconds, and reaction pressure of 0.15-0.4 MPa.

3. The catalytic cracking process for reducing sulfur content in gasoline of claim 1, wherein the spent catalyst from the heavy oil riser reactor and the fluidized bed reactor is subject to coke burning regeneration in condition of regeneration of catalytic cracking catalyst with the regeneration temperature of between 650 and 750° C.

4. The catalytic cracking process for reducing sulfur content in gasoline of claim 1, wherein the heavy oil feed includes atmospheric residual oil, vacuum residual oil, straight-run wax oil, coking wax oil, shale oil, synthetic oil, crude oil, coal tar, recycle oil, oil slurry and deasphalted oil.

5. The catalytic cracking process for reducing sulfur content in gasoline of claim 1, wherein the gasoline feed flowing into the fluidized bed reactor in step (c) is gasoline and/or sulfur-containing gasoline produced in the heavy oil riser reactor.

6. The catalytic cracking process for reducing content of sulfur in gasoline of claim 5, wherein the sulfur-containing gasoline includes catalytic cracking light gasoline, catalytic cracking heavy gasoline, pyrolysis light gasoline, thermal cracking light gasoline, pyrolysis heavy gasoline, thermal cracking heavy gasoline, coking light gasoline, coking heavy gasoline and/or cracked ethylene gasoline.

7. The catalytic cracking process for reducing content of sulfur in gasoline of claim 1, wherein the pre-lift medium of the fluidized bed reactor includes one or more following gas: catalytic cracking dry gas, hydrogen, water vapour and carbon monoxide.

8. The catalytic cracking process for reducing content of sulfur in gasoline of claim 1, wherein the fluidized bed reactor has a diameter of 3-10 times the diameter of heavy oil riser reactor, and the diameter-height ratio of 0.1-0,4.

9. The catalytic cracking process for reducing content of sulfur in gasoline of claim 1, wherein the ratio of regenerated catalyst to the feed of gasoline is 3-10.

10. A catalytic cracking process for reducing sulfur content in gasoline, said process consisting essentially of:

i) feeding a heavy oil feed to a catalytic cracking device containing a heavy oil riser reactor, a first settler, a regenerator, a second settler, wherein the top outlet of the heavy oil riser reactor communicates with the first settler, and the bottom of the heavy oil riser reactor connects with the regenerator through a first regeneration inclined pipe, followed by a first regeneration stand pipe, said device comprises a fluidized bed reactor, wherein a top outlet of the fluidized bed reactor connects with the second settler, and a gasoline feeding inlet is deposited on the fluidized bed reactor, and a lift gas inlet is deposited on a vertical stand pipe below the fluidized bed reactor; the bottom of vertical stand pipe below the lift gas inlet of the fluidized bed reactor is connected with the regenerator through a second regeneration inclined pipe, a second regeneration stand pipe; the regenerated catalyst from regenerator flows into the heavy oil riser reactor and the fluidized bed reactor after cooling through a riser cooler and a fluidized bed cooler;

ii) obtaining under the condition of fluid catalytic cracking in the heavy oil riser reactor, a first reactant flow by reacting the heavy oil feed with a catalyst, and the first reactant flow is isolated in the first settler to obtain isolated spent catalyst and isolated oil-gas, the isolated oil-gas flows into a fractionating device to fractionate and the isolated spent catalyst is subjected to stripping in a stripping section of the first settler and flows into the regenerator, the spent catalyst is subjected to coke burning regeneration in the regenerator under the condition of regeneration of fluid catalytic cracking catalyst to obtain a regenerated catalyst;

iii) providing only regenerated catalyst a portion which flows back into the heavy oil riser reactor through the first regeneration stand pipe, the first regeneration inclined pipe, and the riser cooler, and another portion of which flows into the second regeneration stand pipe and then into the fluidized bed reactor by using a pre-lift medium through the second regeneration inclined pipe and the fluidized bed cooler; and iv) obtaining a second reactant flow by contacting a gasoline feed in the fluidized bed reactor with the regenerated catalyst from step (ii) under the condition that the temperature is 300-550° C., the ratio of the regenerated catalyst to the feed of gasoline is 1-10, and the space velocity is 4.0-60.0 $h^{-1}$, the second reactant flow is isolated in the second settler to obtain isolated spent catalyst and isolated oil-gas, the isolated oil-gas flows into the fractionating device to fractionate, and the isolated spent catalyst is subjected to stripping in a stripping section of the second settler and flows into the regenerator; the regenerated catalyst is recycled in step (iii).

11. A catalytic cracking process for reducing sulfur content in gasoline, said process comprising:

feeding a heavy oil feed to a catalytic cracking device containing a heavy oil riser reactor, a first settler, a regenerator, a second settler, wherein the top outlet of the heavy oil riser reactor communicates with the first settler, and the bottom of the heavy oil riser reactor connects with the regenerator through a first regeneration inclined pipe, followed by a first regeneration stand pipe, said device comprises a fluidized bed reactor, wherein a top outlet of the fluidized bed reactor connects with the second settler, and a gasoline feeding inlet is deposited on the fluidized bed reactor, and a lift gas inlet is deposited on a vertical stand pipe below the fluidized bed reactor; the bottom of vertical stand pipe below the lift gas inlet of the fluidized bed reactor is connected with the regenerator through a second regeneration inclined pipe, a second regeneration stand pipe; the regenerated catalyst from regenerator flows into the heavy oil riser reactor and the fluidized bed reactor after cooling through a riser cooler and a fluidized bed cooler, said process further comprising the steps of;

a) obtaining under the condition of fluid catalytic cracking in the heavy oil riser reactor, a first reactant flow by reacting the heavy oil feed with a catalyst, and the first reactant flow is isolated in the first settler to obtain isolated spent catalyst and isolated oil-gas, the isolated oil-gas flows into a fractionating device to fractionate and the isolated spent catalyst is subjected to stripping in a stripping section of the first settler and flows into the regenerator, the spent catalyst is subjected to coke burning regeneration in the regenerator under the condition of regeneration of fluid catalytic cracking catalyst to obtain a regenerated catalyst;

b) providing a portion of the regenerated catalyst that contains substantially no spent catalyst to the heavy oil riser reactor through the first regeneration stand pipe, the first regeneration inclined pipe, and the riser cooler, and another portion of the regenerated catalyst that contains substantially no spent catalyst to the second regeneration stand pipe and then into the fluidized bed reactor by using a pre-lift medium through the second regeneration inclined pipe and the fluidized bed cooler; and c) obtaining a second reactant flow by contacting a gasoline feed in the fluidized bed reactor with the regenerated catalyst from step a) under the condition that the temperature is 300-550° C., the ratio of the regenerated catalyst to the feed of gasoline is 1-15, and the space velocity is 4.0-60.0$h^{-1}$, the second reactant flow is isolated in the second settler to obtain isolated spent catalyst and isolated oil-gas, the isolated oil-gas flows into the fractionating device to fractionate, and the isolated spent catalyst is subjected to a second stripping in a stripping section of the second settler and flows into the regenerator; the regenerated catalyst is recycled in step b).

* * * * *